US005277424A

United States Patent [19]

Wilms

[11] Patent Number: 5,277,424

[45] Date of Patent: Jan. 11, 1994

[54] VIDEO GAMING DEVICE UTILIZING PLAYER-ACTIVATED VARIABLE BETTING

[75] Inventor: Alfred H. Wilms, Las Vegas, Nev.

[73] Assignee: United Gaming, Inc., Las Vegas, Nev.

[21] Appl. No.: 909,193

[22] Filed: Jul. 8, 1992

[51] Int. Cl.[5] ..... A63F 1/00; A63F 9/24

[52] U.S. Cl. ..... 273/85 CP; 273/138 A; 273/274; 364/412

[58] Field of Search ..... 273/85 CP, 138 A, 138 R, 85 G, 292, 269, 274; 364/410, 411, 364/412

[56] References Cited

U.S. PATENT DOCUMENTS

| | | | |
|---|---|---|---|
| 3,735,982 | 5/1973 | Gerfin | 273/85 CP |
| 4,695,053 | 9/1987 | Vazquez et al. | 273/138 A X |
| 4,861,041 | 8/1989 | Jones et al. | 273/85 CP X |
| 4,948,134 | 8/1990 | Suttle et al. | 273/274 X |
| 4,991,848 | 2/1991 | Greenwood et al. | 273/138 A X |
| 5,100,137 | 3/1992 | Fulton | 273/85 CP |
| 5,116,055 | 5/1992 | Tracy | 273/138 A |
| 5,154,420 | 10/1992 | Gutknecht | 273/138 A |

FOREIGN PATENT DOCUMENTS

| | | | |
|---|---|---|---|
| 3732478 | 3/1989 | Fed. Rep. of Germany | 273/138 A |
| 2174832 | 11/1986 | United Kingdom | 273/138 A |
| 2204436 | 11/1988 | United Kingdom | 273/138 A |

*Primary Examiner*—V. Millin

*Assistant Examiner*—Sebastiano Passaniti

*Attorney, Agent, or Firm*—Brown, Martin, Haller & McClain

[57] ABSTRACT

Video card gaming devices and their method of use are disclosed. These permit players to use extensive wagering strategies analogous to the wagering available with table card games. The invention permits wagering of many denominations of coins, currency or markers and rapid major changes in the total value of each wager. The described video gaming device includes a video screen, money receiver and an operating panel; a player-interactive game operating system; display generator responsive to the game operator to produce a visual display representing the hands of the card game; money identifier to identify the amount of money (or credit) available and wagered; denomination and amount selector to indicate the amount of wager to be applied to each play; and a credit determiner to determine and display the number of plays available at the amount and denomination indicated by the player and to redetermine and display a remaining number of plays available after each play. Also disclosed is method a playing a simulated video card game. The game can be terminated at any time. The gaming devices are usable with any monetary value and denomination of coin, currency and credit indicators (markers); various currency systems can be accommodated.

21 Claims, 3 Drawing Sheets

VIDEO GAMING DEVICE UTILIZING PLAYER-ACTIVATED VARIABLE BETTING

BACKGROUND OF THE INVENTION

1. Field of the Invention

The invention herein relates to video gaming devices for playing of card games and their method of operation. More particularly, it relates to such devices and methods of betting by players for such card games on such devices.

2. Description of the Prior Art

An important element in the popular appeal of conventional table card gaming is the ability provided to a player to change the amount of his or her wager upon completion of each round of play in the particular game, such as twenty-one or one of the varieties of poker. Thus, when on a winning streak, players tend to increase their bets to take advantage of their run of luck. Conversely, when their luck changes and they start having losses, they tend to decrease their bets to minimize those losses. The ability to make such changes to reflect a player's perception of the progress of the game is a major factor in retaining that player's interest in continuing the game, since the player's net winnings or losses are thus a direct result of that wagering strategy.

In recent years, video simulation versions of many of the table card games have come into widespread use. In the video games, an individual player plays against a computer generated simulation of the game, with the computer programmed to reproduce accurately the deal of the cards, and these games have proved quite popular. Wagering has, however, been constrained by the nature of the prior art devices. Initially such video games provided only for a wager that was constrained by the denomination allowed by the device. In a "quarter machine," for instance, a player could wager only multiples of twenty-five cents on each round of play. The game could not be activated except by depositing one or more quarters into the machine or betting accumulated twenty-five cent credit units held in memory by the device. The amount of a winning payoff was based solely on the card hand which was generated by the computer.

Subsequently, video game devices were constructed that allowed deposit of one or a few coins (commonly from three to eight) in a "multiplier" or "multi-line" configuration with payoff for a specific hand being directly proportional to the number of coins deposited. However, as with the earlier devices, wages made on these types of devices are limited only to increments of a single coin type; a quarter machine will accept quarters but will not accept any other type of coin, so the player is limited as to the maximum wager that can be made. Thus, while a player can decrease his or her wager to a single coin while on a losing streak, the player is essentially prevented from taking advantage of a winning streak to make significantly increased wagers. This of course markedly reduces potential players' interest in the video card games.

The problem cannot be resolved by simply permitting the wagering of a large number of coins or credits per round. However large the amount of coins or credits wagered per round, the wager still has a minimum and maximum limit dictated by the defined denomination. Thus, a dollar player must continue to wager a minimum of one dollar or a one-dollar credit on each round. In the case of physical coin wagers, the extensive time required for a player to deposit a large wager coin-by-coin greatly reduces the speed of the game. It is well known that when a significant time interval elapses between each round of play, players quickly lose interest in continuing the game. Consequently, it may be considered that the current video gaming devices have reached a "dead end" with respect to increasing players' interest, since any significant increase in wagering capability is offset by a substantial decrease in the cycle time for play of the game.

It would therefore be advantageous to have a new type of video card gaming device which would permit a player to make substantial upward or downward changes in wagering between any two rounds or hands of play of the game, without significantly increasing the length of the time interval between such rounds or hands. Such would permit the ongoing game to continue at the normal pace that the player expects, while yet providing opportunities for the player to capitalize on a winning streak or minimize losses during a losing streak.

SUMMARY OF THE INVENTION

The video card gaming devices of the present invention and their method of use are based on a major departure from the wagering concepts of the prior art video card gaming devices, and permit players to engage in a much wider range of wagering strategies for each hand or round of play, in a manner virtually analogous to the type of wagering available with table card games. The major innovations of the present devices are in their handling of many different denominations of coins, currency or credit indicators and their ability to provide a player with the opportunity to make major changes in the total value of each wager. Thus the player can utilize all of the various strategic wagering skills which he or she posses substantially as would be done at a table card game, and the player is not artificially limited by a wager handling capability of a device with an effective cap of only a few coins.

As will be discussed below, the present video gaming devices can be programmed for a wide variety of different card games, since the present invention deals with the denomination and total amount of money wagered on each round, not on what the card game itself is, how it is played or what a "round" or "hand" constitutes. For the purposes of illustration, however, the gaming devices of the present invention will be described initially in terms of the play of five-card draw poker. It will be understood of course that this is simply an example of a card game of chance and not intended to be a suggestion that the gaming devices of the present invention are limited solely to video poker games.

Specifically, in one major aspect, the invention herein is a video gaming device for playing of a card game and comprising a housing containing a video screen, money providing means and an operating panel; card game playing means incorporated into the panel and adapted to be manipulated by a player to play the card game; generation means responsive to the card game playing means to display on the video screen visual indicia representing card sequences appropriate to the card game; identification means operably associated with the money providing means to determine a monetary value of money provided therethrough; denomination selection means incorporated into the panel and adapted to be manipulated by the player to indicate a unit of wager to be applied to a single play of the card game; wagering means incorporated into the panel and adapted to be manipulated by the player to indicate a wager to be applied to the single play of the card game; credit determining means operably associated with the identification means, denomination selection means and wager means to determine a number of plays of the card game available to the player at the amount of wager and denomination indicated by the player and at the monetary value of the money provided and credited; and display means responsive thereto to display the number of such available plays on the video screen; the credit determining means further comprising means to redetermine and display a remaining number of plays available to the player after each individual play and after any change in determination of the amount of wager by the player.

In another aspect, the invention is a method for playing a card game by means of a video gaming device which comprises generating and displaying on a video screen visual indicia representing at least one card of the card game; manipulating game playing means to which the video screen is responsive to play the card game; operably providing to the gaming device an amount of money, and determining the monetary value of the amount of money; selecting the amount of wager to be applied to each single play of the card game; and determining from the monetary value and the wager selection the number of plays of the card game available and displaying the number of such available plays on the video screen; redetermining and displaying a remaining number of plays available after each individual play and after any change in indication of the amount of wager.

The invention also includes means in the apparatus to terminate play of the game, either upon command of the player or automatically when no available plays remain.

The gaming devices of this invention are usable with any monetary value and denomination of coin, currency and credit indicators (markers). They may be used with any type of card game of chance which can be properly simulated electronically, particularly the variants of poker or "21".

As used herein, the term "money" may mean cash (coins and/or currency) or machine-indicated credits or both. Thus, "money deposited" with respect to a specific hand or round of play may refer to cash input to the device at that time or to a signal to the device to accept one or more accumulated credits as "money." The particular meaning at any point will be evident from the context.

BRIEF DESCRIPTION OF THE DRAWINGS

FIG. 2 is a schematic representation of the video display screen of the device of FIG. 1 showing a representation of the screen after an initial wager.

FIG. 3 is a schematic representation similar to that of FIG. 2, showing the video screen display at a subsequent round in a game, exemplified by a card game of chance.

FIG. 4 is a schematic representation of similar to that of FIG. 3 showing the video screen display at yet a later round of the game.

DETAILED DESCRIPTION AND PREFERRED EMBODIMENTS

Figure 1:
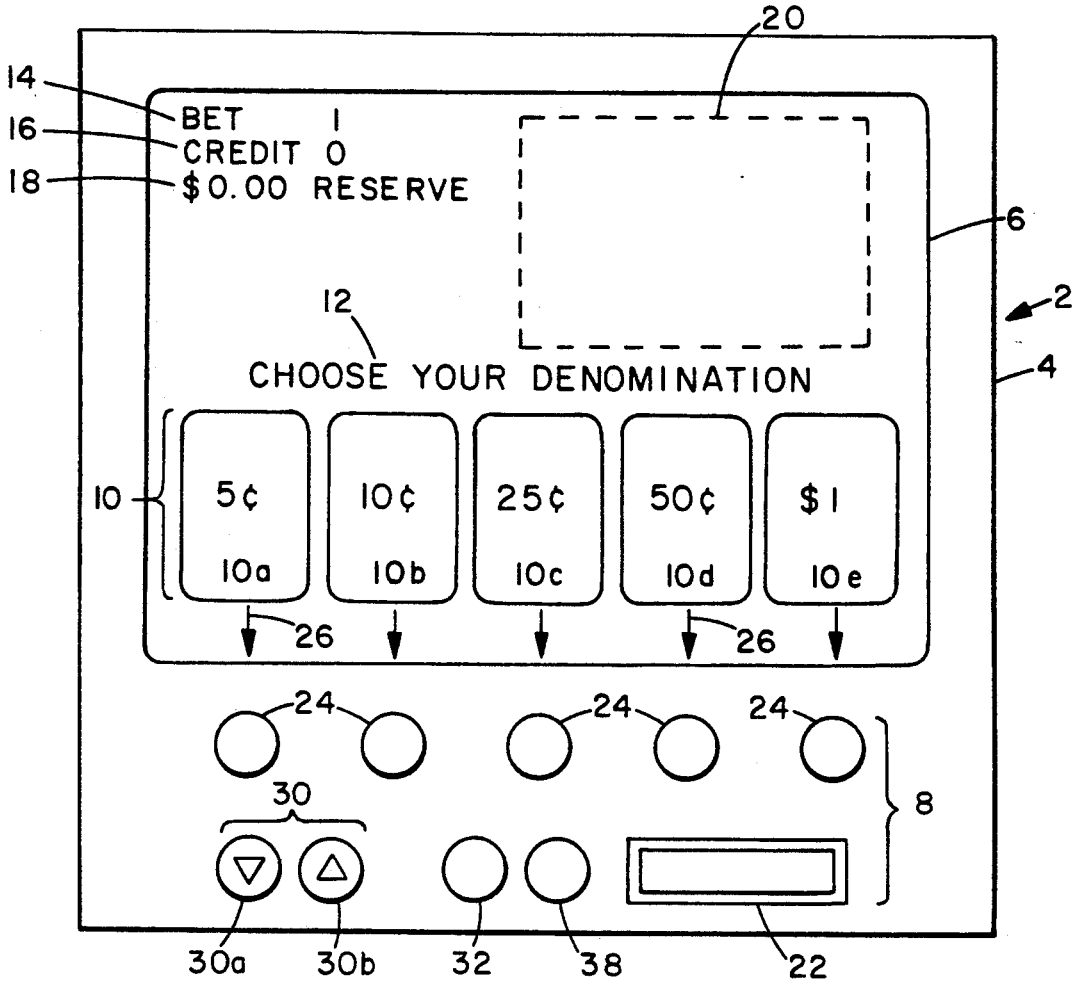
FIG. 1 is a schematic representation of the front of a typical video gaming device of the present invention, illustrating the video screen (with an initial representation of the game at the wagering step) and the control panel of the device.

Considering first FIG. 1, a gaming device generally designated 2 is illustrated, which is typically housed within a video game housing 4. This housing 4, which may be mounted on a table, pedestal or other support (not shown), or within another cabinet-like environment, has two front areas for interaction with the player, a video display screen 6 and a control panel 8.

FIG. 1 illustrates a typical image displayed on the video screen during the "idle" period prior to the start of a game by a player. If desired, this image can alternate with an "attract mode" image or sequence of images designed to draw a prospective player's attention to the gaming device and stimulate his or her interest in playing the game.

In the image shown in FIG. 1, there are a series of areas 10, individually identified as **10*a*-10*e*, which signify individual monetary denominations of a potential wager. In the example shown, the denominations represent the standard U.S. coins (except the penny) and the one dollar denomination. A legend 12 instructs the player to select a denomination for the initial wager. The areas 10 and the legend 12** will disappear from the screen once the denomination of the wager has been selected and they will be replaced by representations of the game cards, as will be described below.

Also displayed on the screen are a group of legends 14, 16 and 18 which indicate the current wager status at each point in the progress of the game. The BET indicator 14 shows the number of units of the designated denomination which the player is wagering on the next round of the game. The CREDIT indicator 16 indicates the number of additional units of that denomination which the player has as credits available from the amount of money previously deposited and previous winnings. The RESERVE indicator 18 shows the monetary value of any fractional units of the denomination which are also credited to the player, as will be described below. The legends 14, 16 and 18 will normally be displayed on the screen at all times so that the player is continually aware of the wager status.

Commonly there may also be represented, as in area 20, other legends describing the various winning combinations of the card game and their respective payouts. For instance, in the example poker game the rank of the various poker hands and their relative payout values will normally be displayed. The legends in area 20 regarding the game options may be continually displayed or deleted during the progress of each hand after wagering is completed, as desired and appropriate for each type of game.

To initiate play of the game, the player deposits a certain number of coins, bills or credit indicators (which as noted may collectively be referred to herein as "money") into the gaming device through slot 22 in control panel 8. Slot 22 communicates directly with conventional recognition apparatus (not shown) within housing 4, which has the ability to identify and differentiate each of the possible coins, bills or credit indicators which the player may insert. For instance, the coin recognition portion of the apparatus would typically be able to differentiate among nickels, dimes, quarters or half-dollars, while a currency recognition device in the apparatus would be able to scan the deposited currency and identify the denomination of each bill as by optical character readers. The device, if desired, may also be able to distinguish and identify credit indicators, such as typical casino markers, which represent different values of credit that a player has previously accumulated. It is common for casinos to use different colored tokens or "markers," which may also have denominations written on them, as coin or currency substitutes within the casino. These can be identified when played in the gaming devices of the present invention either by scanning with a color recognition system or an optical reader if the denomination is printed on each disc or marker. Also within the apparatus would be accumulators which would continually total the amount of coins, currency or markers which were deposited and display that accumulated total as a credit on the screen at 16. Normally such accumulation and display will be part of the software program that operates the overall displays on screen 6 and the play of the game. Further, the recognition and accumulation systems within the gaming devices may be set, usually through software, to identify any type of coins or currency, so a player could insert and the device would accept coins and currency of two or more designated countries, greatly facilitating international gaming.

Figure 2:
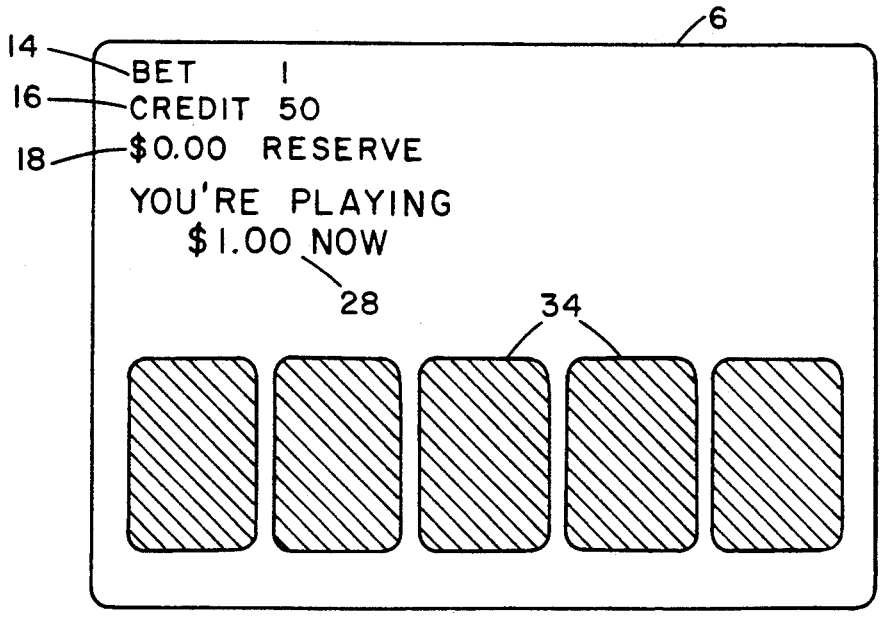
In FIGS. 2-4 the example illustrated is the play of five-card draw poker.

After the player has inserted the desired initial amount of money into the gaming device through slot 22, he or she pushes one of the buttons 24, each of which is uniquely associated with one of the denomination indicators on the screen as by arrows 26, to indicate which denomination of money the player wishes to use for the next round of the game. The internal programming of the device then immediately displays the number of units of credit for that denomination at 16. This is illustrated in FIG. 2, where, in this example, the player has inserted $50 in coins or currency and has designated a $1 denomination for the initial wager at which is displayed at 28. The player is then shown as having 50 credits (CREDIT at 16) and a $0.00 RESERVE, since there is no fractional dollar unit remaining from the $50 deposit. If the amount of money deposited had not totaled a whole number of units of the denomination chosen, the remaining fractional unit would have been converted to a monetary value and displayed as RESERVE at 18.

After the denomination is chosen, the player pushes another button 30 to indicate how many units of that denomination he or she wishes to wager on the next round. Pushing this button 30 will change the numeral at 14 indicating the number of units BET. The CREDIT designation at 16 will decrease correspondingly as the wager is registered. The programming of the device may be set so that a single unit of the indicated denomination is the default wager. Button 30 will then need to be pushed only if the player wishes to bet more than a single unit of the denomination.

If the programming of the device is such that the default returns to one unit after each round, only a single button 30 will be needed to raise that wager when desired. Preferably, however, to speed play of the game the device will be programmed so that the designated number of units bet carries forward from round to round until changed, in which case the device will normally have a pair of buttons **30*a* and 30*b*, one of which (30*a*) decreases the number of units wagered and the other of which (30*b***) increases the number of units wagered.

Once the total wager (denomination and units) is laid, the game proceeds as with any other similar video card game. In the poker game illustrated, as shown next in FIG. 2, a series of five cards 34 are displayed with their individual suits and face values. The player then examines the hand displayed and decides whether to play that hand or seek replacement of one or more of the cards 34 in an attempt to obtain a higher value hand. The interaction between the device and the player for communicating the player's decision to the device game operating system can be, for instance, by pressing of the appropriate buttons 24 which are now aligned with the card representations 34 and which, through the appropriate software programming or device circuitry, will generate representations of replacement cards for those individual cards 34 which the player wishes to discard. If the player wishes to retain the hand as originally dealt, there is an additional button such as 32 to indicate that the player is playing that hand. Then when either button 32 is pressed or the desired number of cards have been changed through the buttons 24, the system determines the final value of the player's hand and either declares the hand to be a loser or pays the appropriate payout amount for a winning combination as determined by the ordinary rules of the game. If the hand is a winning hand, the number of units won are immediately added to the CREDIT indication 16, and a screen equivalent to that in FIG. 1 is regenerated to afford the player the opportunity to change the denomination and/or units wagered for the next round. Commonly in order to speed play of the game, the denomination previously chosen is retained as the default denomination. The player can then use buttons **30*a* or 30*b* to raise or lower the units wagered or can press the DEAL activation button 32** to indicate that the previous number of units wagered is to be repeated, so that the next round immediately begins.

At every interval between rounds the player must of course provide additional money to the device. For the purposes of this invention, this provision of money may come in different ways. First, the player may actually insert cash or credit markers into the device through slot 22, as described for the start of the game above. That will be necessary when the monetary value of the player's accumulated credits declines to a level below the amount the player wishes to bet. Alternatively, if the player has accumulated credits of sufficient monetary value, the player may "provide money" simply by indicating through the appropriate buttons what denomination and how much of that denomination he or she wants to bet, and the device will deduct the designated amount from the accumulated CREDIT total as described. Of course, the player can do both before any hand—actually add cash or credit markers, which will immediately show up as additional CREDIT at 16, and then wager some or all of the accumulated credits.

Figure 3:
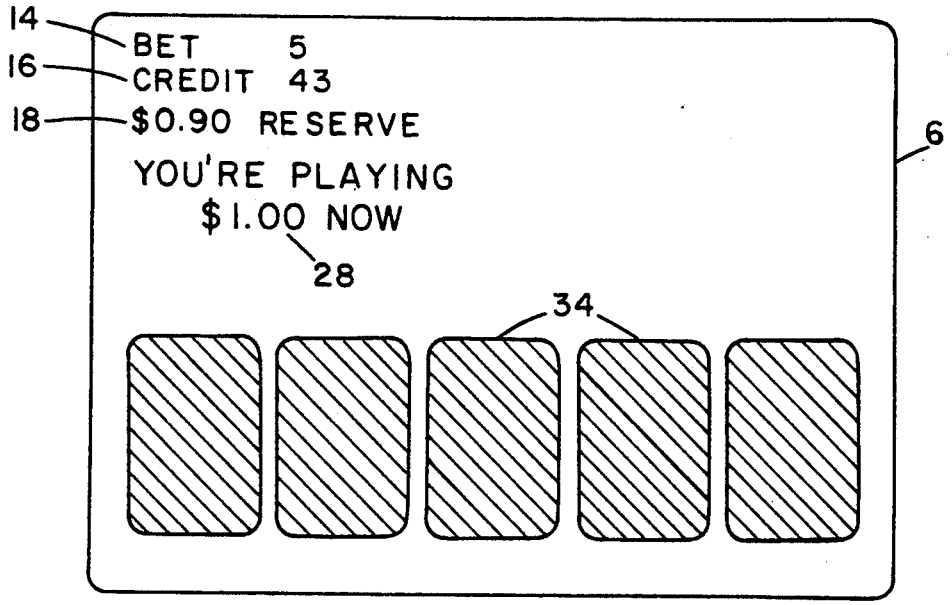

Ongoing play is further illustrated in FIG. 3. In the situation illustrated, the player has previously played a number of rounds, and through the combination of different denominations and various winning and losing hands, has accumulated a credit of $43.90. At this particular point, the player has selected $1.00 as the desired denomination for the next round and he or she is betting five units ($5.00). Since $43.90 does not represent an integral number of $1.00 units, the remaining fractional unit ($0.90) is shown as the RESERVE 18.

Figure 4:
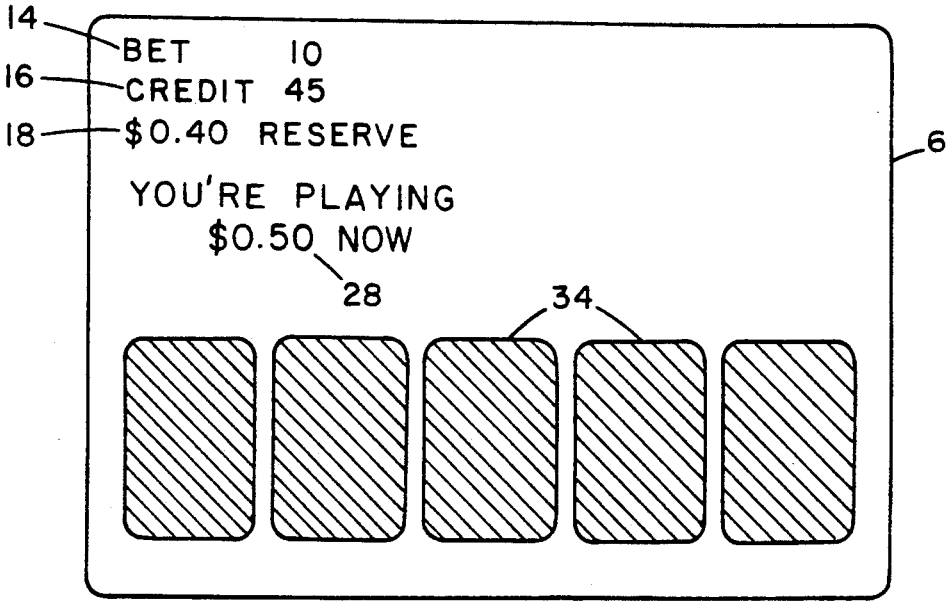

A still further stage in the play of the game is illustrated in FIG. 4. At this point, the player's accumulated deposits and winnings equal $22.90 and the player has designated $0.50 as the current denomination for the forthcoming round at 28. $22.90 in half-dollar units represents 45.8 units, which is represented as a CREDIT of 45 units at 16 and a RESERVE of $0.40 (80% of $0.50) at 18. Also illustrated at 28 is the player's indication that he or she is wagering 10 half-dollar units ($5.00) on the next hand.

The play thus progresses from round to round, with the player being given the option (by repeated regeneration of a screen equivalent to that of FIG. 1) to change the wager denomination as well as the number of units of that denomination to be wagered for the subsequent round, and to increase credits available by inserting cash or markers.

The device also preferably includes means such as button 38 for the player to indicate at the end of any round that he or she wishes to be paid out for either the total accumulated credits or, if the hand played was a winner, for the payout for that particular hand. This is an interim payout, not associated with the termination of the game described below. The appropriate amount of coins will then be dispensed into a collection bin (not shown) and the player may continue with the next round, inserting additional cash or markers into the device if necessary.

The representation of denominations shown in FIG. 1 is not meant to be limiting, and higher denominations (such as $50 or $100 denominations) can be displayed. Optionally one can include in the system the capacity for the denomination display to be changed by the player before indicating the wager, so that the player may shift to much larger or smaller denomination bets as part of the playing strategy with the progress of the game. Thus, the buttons 30 could be programmed so that if one is pushed before one of the buttons 24 is pushed, the appropriate system software or circuitry causes the denominations illustrated to be increased or decreased by predetermined amounts or by a predetermined factor, such as multiplication by 100. For instance, in the example shown, a 100-fold change would increase the denominations from a range of 5¢ to $1.00 to a new range of $5.00 to $100.00. Similarly, the system can provide means, such as a dual functionality of button 32, to change the denomination display to monetary units of various countries. Thus, if button 32 is pushed sequentially while the denomination screen is displayed, it changes through a predetermined display sequence of national currencies. When the desired national currency is displayed, the player uses a button 24 to select the desired denomination, and the system software or circuitry shifts button 32 to its DEAL function. Thereafter the player then returns to buttons 30 to indicate the number of units of that denomination to be wagered as described above.

When the number of credits available to the player through the combination of deposits of money and game outcomes drops below a single unit value of denomination being played, the player must terminates the game and cash out or select a lower wagering denomination. The CREDIT indication at 16 will then change accordingly. Thus, if the player has been wagering at a one-dollar denomination, and the dollar credit total drops to $0.95, the player may select, for instance, to change to the nickel denomination, whereupon the CREDIT indication will change to register nineteen credits available.

If the player decides to voluntarily terminate the game with any credits (full or partial) remaining, he can indicate that choice by pressing the appropriate button between rounds of a game before any denomination designation is made. For instance, button 32 could be programmed so that in addition to the national currencies that button 32 sequences through, an additional choice in the sequence would be TERMINATE. The apparatus would be programmed to then pay out in coins or markers the total monetary amount of the player's remaining accumulated credits, including any fractional RESERVE credit.

Figure 5:
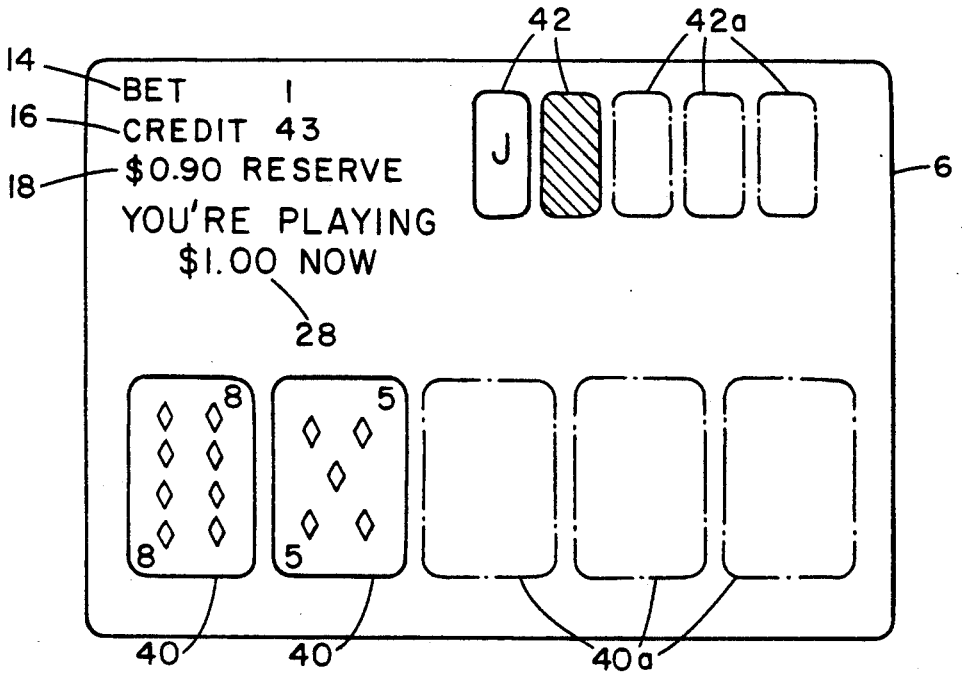
FIG. 5 is a schematic representation of the video display screen of the device of FIG. 1 showing a representation of the screen after an initial wager when the game being played is "21" or its variant, blackjack.

The above description has been given in terms of a video card game exemplified by five-card draw poker. It will be recognized that a number of other card games can also be simulated electronically and displayed on the screen 6 with an appropriate layout of control panel 8 to allow the necessary indications of betting and game play. Typical games which can be represented include other forms of poker, "21" (including its variant blackjack), and the like. The displays generated will of course differ in accordance with the rules of the particular game being played. For instance, as shown in FIG. 5 an initial "21" screen will show the player's two dealt cards 40 and the dealer's face-up and face-down cards 42. As the play progresses additional card representations 40*a* and 42*a*, as shown in phantom, may appear as determined by the rules and play of the game. The system will be programmed so that as play progresses cards also will appear face-up or face-down as determined by the game rules.

The device's circuitry, or preferably computer programming software, will be designed such that all necessary rules of the game are recognized by the system and applied correctly as the game progresses. This will include recognizing the proper deck to be used (for instance, with or without jokers), "shuffling" the deck, dealing in correct order through the deck, and remembering and not repeating the cards which have already been played in a hand. Such circuitry and software are presently available and are used in the prior art machines; they are equally suitable here. The difference with the present invention is not the play of the game, but the unique wagering capabilities presented to the player.

It will be evident that there are numerous embodiments of these novel card gaming devices which, while not specifically described above, are clearly within the scope and spirit of the invention. The above description is therefore intended to be exemplary only and the scope of the invention to be limited solely by the appended claims.

I claim:

1. A video gaming device for playing of a card game and comprising:

a housing containing a video screen, money providing means and an operating panel;

card game playing means incorporated into said panel and adapted to be manipulated by a player to play said card game;

generation means responsive to said card game playing means to display on said video screen visual indicia representing card sequences appropriate to said card game;

identification means operably associated with said money providing means to determine a monetary value of money provided therethrough;

denomination selection means incorporated into said panel and adapted to be manipulated by said player to indicate a unit of wager from a plurality of possible units of wager to be applied to a single play of said card game;

wagering means incorporated into said panel and adapted to be manipulated by said player to indicate a wager to be applied to said single play of said card game;

credit determining means operably associated with said identification means, denomination selection means and wager means to determine a number of plays of said card game available to said player at said amount of wager and denomination indicated by said player and at said monetary value of said money provided and credited; and display means responsive thereto to display said number of such available plays on said video screen;

said credit determining means further comprising means to redetermine and display a remaining number of plays available to said player after each individual play and after any change in determination of said amount of wager by said player.

2. A video gaming device as in claim 1 wherein said money providing means comprises a money receiver incorporated into said housing and communicating with said identification means, said identification means adapted to receive money therefrom and determine the monetary value of said money inserted into said receiver.

3. A video gaming device as in claim 1 wherein said money providing means comprises indicator means incorporated into said housing, adapted to be manipulated by said player and communicating with said identification means, said identification means in response to said manipulation of said indicator means by said player determining a monetary value of credits previously accumulated by said player.

4. A video gaming device as in claim 1 wherein said card game is a variety of poker.

5. A video gaming device as in claim 1 wherein said card game is a variety of "21".

6. A video gaming device as in claim 1 wherein said denomination selection means may be activated by said player following completion of any individual game play to change said wager for a next following game.

7. A video gaming device as in claim 1 wherein said denomination selection means retains the most recently indicated wager following completion of any individual game play for a next following game unless activated by said player to change said wager.

8. A video gaming device as in claim 1 wherein said credit determining means further comprising means to maintain and display any fractional play credit.

9. A video gaming device as in claim 8 wherein said fractional play credit is displayed as a monetary equivalent.

10. A video gaming device as in claim 1 further comprising means to terminate the play of the game.

11. A video game device as in claim 1 wherein said credit determining means comprises means to accumulate said determined play credits for all amounts of said received money and to deduct from said accumulated credits a play credit for each play completed.

12. A video game device as in claim 11 wherein individual portions comprising said amount are received by said money receiving means at different times while said play credits exceed one.

13. A method for playing a simulated card game by means of a video gaming device which comprises:

providing in said device system operation means to operate, in combination, a video screen, money providing means, player's control area, generation means responsive to a card game playing means to display on said video screen visual indicia representing card sequences appropriate to said card game, and identification means operably associated with said money providing means to determine a monetary value of money provided therethrough;

activating denomination selection means incorporated into said operating area to generate a signal to said system operating means to indicate a unit of wager to be applied to a single play of said card game;

activating wagering means incorporated into said operating area to generate a signal to said system operating means to indicate a wager to be applied to said single play of said card game;

in response thereto calculating a number of plays of said card game available to said player at said amount of wager and denomination indicated by said player and at said monetary value of said money provided and credited;

responsive thereto displaying said number of said available plays on said video screen;

generating and displaying on said video screen visual indicia representing the implements of said card game;

activating card game playing means incorporated into said operating area to play said card game; and following each play of said card game redetermining and displaying a remaining number of plays available to said player after said individual play and after any change in determination of said amount of wager by said player.

14. A method as in claim 13 wherein said card game represented is a variant of poker.

15. A method as in claim 13 wherein said card game represented is a variant of "21".

16. A method as in claim 13 further comprising terminating the play of the game.

17. A method as in claim 13 wherein said wager selection may occur following completion of any individual game play to change said wager for a next following game.

18. A method as in claim 13 wherein said wager selection indication continues following completion of any individual game play and is continued for a next following game unless a different wager is selected.

19. A method as in claim 13 further comprising determining, maintaining and displaying any fractional play credit.

20. A method as in claim 19 wherein said fractional play credit is displayed as a monetary equivalent.

21. A method as in claim 13 further comprising determining and accumulating play credits for all amounts of said received money and deducting from said accumulated credits a play credit for each play completed.

* * * * *